US006190537B1

(12) United States Patent
Kanataev et al.

(10) Patent No.: US 6,190,537 B1
(45) Date of Patent: Feb. 20, 2001

(54) METHOD FOR PRODUCING FUEL DISTILLATES

(75) Inventors: Juri Alekseevich Kanataev, Moscow; Mikhail Konstantinovich Julin, Bronnitsy Moskovskoy; Evgeny Aleksandrovich Ruzhnikov, Novomoskovsk Tulskoy; Valentin Dmitrievich Efimenkov, Moscow, all of (RU)

(73) Assignee: Zakrytoe Aktsionernoye Obschestove "Panjsher- Holding", Moscow (RU)

( * ) Notice: Under 35 U.S.C. 154(b), the term of this patent shall be extended for 0 days.

(21) Appl. No.: 09/354,898

(22) Filed: Jul. 16, 1999

Related U.S. Application Data

(63) Continuation-in-part of application No. PCT/RU98/00153, filed on May 22, 1998.

(51) Int. Cl.[7] ..... C10G 47/24; C10G 9/00
(52) U.S. Cl. ..... 208/107; 208/126; 208/127
(58) Field of Search ..... 208/107, 126, 208/127

(56) References Cited

U.S. PATENT DOCUMENTS

| | | | | |
|---|---|---|---|---|
| 3,151,057 | * | 9/1964 | Schuman et al. | 208/111.3 |
| 4,035,281 | | 7/1977 | Espenscheid et al. | 208/8 |
| 4,046,670 | * | 9/1977 | Seguchi et al. | 208/48 AA |
| 4,299,685 | * | 11/1981 | Khulbe et al. | 208/48 AA |
| 4,487,687 | * | 12/1984 | Simo et al. | 208/56 |
| 4,544,479 | | 10/1985 | Yan | 208/106 |
| 4,999,328 | * | 3/1991 | Jain et al. | 502/151 |
| 5,395,511 | * | 3/1995 | Kubo et al. | 208/111.3 |
| 5,795,464 | * | 8/1998 | Sankey et al. | 208/391 |
| 5,972,202 | * | 10/1999 | Benham et al. | 208/107 |
| 6,004,453 | * | 12/1999 | Benham et al. | 208/108 |

FOREIGN PATENT DOCUMENTS

| | | |
|---|---|---|
| 1 163 222 | 3/1984 | (CA) . |
| 2009166 | 3/1994 | (RU) . |
| 2057786 | 4/1996 | (RU) . |
| 2076891 | 4/1997 | (RU) . |
| 520924 | 2/1974 | (SU) . |

OTHER PUBLICATIONS

Oil & Gas Journal, Mar. 22, 1982, Refining Issue, Heavy–oil project pushed at complex refinery pp. 82–91.

* cited by examiner

*Primary Examiner*—Walter D. Griffin
(74) *Attorney, Agent, or Firm*—Graybeal Jackson Hale LLP

(57) ABSTRACT

Methods for producing fuel distillates used as raw material in the production of fuel for engines or jet engines. The invention involves mixing residual petroleum raw material (oil fuel, tar) with sapropelite and with a fraction of thermo-cracking or hydro-cracking hydrogenated products having a boiling point of between 300 and 400° C. in an amount of between 1 and 5% relative to the weight of the residual petroleum raw material. The mixture is heated, homogenized at least twice in a dispersing agent at a temperature of between 85 and 105° C., and submitted to a thermo-cracking or hydro-cracking process. The fuel distillates (petrol, diesel fuel and gas oil) are then separated from the thermo- or hydro-cracking products. The invention thus pertains to the production of petroleum fuels and may be used in the oil-conversion industry.

3 Claims, No Drawings

METHOD FOR PRODUCING FUEL DISTILLATES

This is a continuation-in-part of co-pending International Application PCT/RU98/00153 filed on May 22, 1998 designating the United States.

FIELD OF THE INVENTION

The present invention relates to oil refinement and more particularly to methods for producing fuel distillates from oil residual stock by hydrogen or thermal cracking using donor solvent processes.

The evolution of oil processing technology poses a problem of a more profound oil refinement, which cannot be solved without extensively implementing the methods for secondary treatment of the oil residual stock, such as black oil, tar and heavy hydrocarbon oils (malthas), containing large concentrations of heavy metals, primarily vanadium and nickel.

BACKGROUND OF THE INVENTION

As for now, one of the most prospective ways of solving the above problem is to carry out simultaneous thermal cracking of oil residues mixed with coal, wherein coal is taken in the amount of 5–30 percent with respect to oil mass (U.S. Pat. No. 4,544,479, 1985; RU, A, 2009166, 1994).

The prior art method includes subjecting the mixture to a light thermal cracking (visbreaking), the main product of which is heavy oil stock with a reduced concentration of metals.

The stock and its distillates can be converted to light oil by catalytic cracking.

The prior art method, however, suffers a number of problems. A relatively low demetalization level provided by this method does not entirely eliminate the problems which arise at further catalytic cracking of the process product, as even in the case of employment of modern metal-resistant catalysts their consumption should be high which adversely affects the cost efficiency of the prior art method.

Another prior art used to solve the aforementioned problem is a method of thermal hydrogen cracking of heavy oil residues, which is referred to in literature as the Aurabon-process (Edward G. Haude, Gregory G. Ionompson, and Robert E. Denny, The Aurabon process: a valuable tool for heavy oil conversion, presented at the AOSTRA Conference, Edmonton, Alberta, Canada, Jun. 6–7, 1985). The advantage of this process is its technological flexibility: modification of the process conditions (temperature, pressure, contact time, etc.) allows the conversion degree and the yield to be varied. Under the most stringent conditions of the Aurabon process, the treatment of black oil from Voskan oil yields, in percentage by mass: gas 5.6, gasoline 4, diesel distillate 14, vacuum gas oil 65, residue 13. Gasoline and diesel distillate are used for further refinement to produce fuel components.

A complicated and yet unsolved problem with the thermal hydrogen cracking is the possibility of coke deposition on the apparatus walls, requiring a periodic stopping of the process and adversely affecting its technical and economical properties.

Most closely approaching the present invention is a method of producing fuel distillates from oil residual stock, including mixing the oil residual stock with sapropelite and a liquid aromatic additive, subjecting the resulting mixture to hydrogen or thermal cracking, and extracting desired products. (RU, A, 2057786, 1996; RU, A, 2076891, 1997).

In the prior art method, the thermal or hydrogen cracking is carried out on a mixture containing a heavy oil stock (tars, mixtures of West-Siberian oils, oils from Romashka and Ukhta fields and heavy oil from Bouzatchi field in Mangyshlak), sapropelite (Leningrad or Baltic sulfurous shale or Kuzbass sapromixite) in the amount of 1 to 10 percent by mass, and shale oil or its fraction boiling at 220–340° C. in the amount of 1 to 10 percent by mass at increased temperature and pressure, with subsequent extraction of fuel distillates. The yield of fuel distillates is 56–60 percent by mass with respect to the feed stock after being subjected to thermal cracking and 90 percent after being subjected to hydrogen cracking. Using the hydrofining process, the thermal and hydrogen cracking distillates may be refined to light motor fuels, including motor gasoline and diesel fuel.

The problem with the prior art method is the employment of tetralin or alkyl derivatives thereof as the aromatic additive. Liquid products containing tetralin or alkyl derivatives thereof and their mixtures with other hydrocarbons are produced by hydrogenating technical products containing condensed aromatic hydrocarbons, mainly naphthalene and alkyl derivatives thereof. The process of producing tetralin and its alkyl derivatives is quite costly, consequently, the final product is relatively expensive also. The high price of tetralin hinders the employment of the prior art processes in the oil processing industry.

SUMMARY OF THE INVENTION

It is an object of the present invention to improve efficiency of a method for producing fuel distillates and to reduce the final product cost.

The present invention allows the elimination of employing tetralin or its alkyl derivatives in the process, while the yield of fuel distillates is maintained and even increased.

The above technical result is attained by a method for producing fuel distillates from oil residual stock, including mixing the oil residual stock with sapropelite and a liquid aromatic additive, subjecting the resulting mixture to hydrogen or thermal cracking, and extracting desired products, wherein prior to the hydrogen or thermal cracking the mixture is subjected to at least double-stage homogenization in an activator at a temperature between 85 and 105° C., the liquid aromatic additive being a fraction of hydrogenated thermal or hydrogen cracking products boiling at 300–400° C., taken in the amount of 1–5 percent by mass with respect to the oil residual stock.

At the double-stage homogenization in the activator, the mixture can be maintained at a temperature of 85–95° C. at a first stage and 95–105° C. at a second stage.

The mixture can be also subjected to a three-stage homogenization in the activator at a temperature of 85–95° C. at the first stage, 95–105° C. at the second stage and 105–135° C. at the third stage.

In accordance with the invention, a heavy oil stock (black oil, tar) is sequentially mixed with a liquid product and sapropelite. Sapropelite is pre-crushed to particles of a size under 0.1 mm, preferably less than 0.8 mm. Sapropelite can be crushed even to the finer particles as small as 50 to 100 $\mu$m. The resulting mixture is subjected to a single-, double- or three-stage homogenization in an activator at a temperature between 85 and 135° C. In the homogenization process, the feed stock is partially activated both mechanically and chemically, the additives being evenly distributed throughout the feed stock volume. The size of additive particles (0.3–0.5 nm) matches the size of oil stock molecules (0.4–0.7 nm). This circumstance is of paramount importance in provision of the optimum contact between the additives and the oil stock molecules. After being subjected to the above treatment, the feed stock forms the stable mixture which does not segregate for a long time.

When the homogenization is carried out in an activator at a temperature under 85° C., the efficiency of mechanical and chemical activation of the feed stock noticeably worsens and necessitates the extension of the treatment stages to attain the comparable results. It is inadvisable to raise the homogenization temperature above 135° C. as this requires the considerable increase of power consumption and makes the final product produced by this method more expensive.

An activator in the present invention is a conventional apparatus used in petrochemical industry for similar purposes.

The concept of thermal cracking or hydrogen cracking is used herein in its conventional meaning and refers to contacting a feed stock to be cracked with hydrogen in the amount of 500 to 2000 volumes of hydrogen or hydrogen-containing gas under the normal conditions (T=0° C., P=0.1013 MPa) per a volume of liquid stock at a pressure of 4.0–15.0 MPa, a space velocity of 1–3 $h^{-1}$ (conditional contact time—20–90 min) and a temperature between 390 and 440° C.

The reaction equipment generally used in industry includes pipe kilns or pipe kilns with an extension reaction chamber. In the laboratory conditions, the commercial process data can be adequately simulated both when conducting the process in an autoclave and in a flow-through system with a reactor volume of 6.1. The optimal conditions (temperature, pressure, velocity) are those providing the highest amount of the desired product, without undesired substantial coke deposition, especially in a pipe kiln. Upon being held in the reactor assembly for a predetermined time, the cracked products are cooled and separated so that to extract the desired products. The common separation methods are: evaporation under a reduced pressure (as compared with the reaction conditions), separation of liquid products from slurry (concentration of solids) which is carried out by any conventional methods, e.g. by centrifuging, vacuum distillation, etc., separation of liquid and vapor reaction products, etc.

For sapropelites, the use can be made of any sapropelites of such sort as shales, sulfurous shales, sapromixites, etc., and the products of benefication thereof.

For oil residual stock, the use can be made of any stock of such sort as black oil, tar, heavy oils (malthas), etc.

Used as a liquid, aromatic additive can be a prehydrogenated fraction boiling at 300–400° C., produced by thermal and hydrogen cracking of heavy oil residues. The fraction contains a considerable quantity of hydrogen derivatives of polycyclic aromatic compounds. The basic compounds are represented by a group of 2- to 4-cyclic hydroaromatic hydrocarbons (di-, tetra- and hexaderivatives of alkylated naphthalene, anthracene, phenanthrene, benzanthracene, pyrene, fluoranthene, chrysene). The aforementioned fraction acts as the effective hydrogen donor in thermal and hydrogen cracking of the oil residual stock. The liquid aromatic additive is introduced in the amount of 1 to 5 percent with respect to the oil residual stock mass.

In principle, liquid products containing tetralin and alkyl derivatives thereof can be also employed as the aromatic additives in the present method. The homogenization step added in the present invention provides the increased yield of fuel distillates even if tetralin is employed. However, as mentioned before, the employment of tetralin essentially raises the cost of the final product.

According to the present invention, for the liquid aromatic additives, the use can be made of sapropelite gasification liquid products known as shale oil or its fraction boiling at 220–340° C. The employment of shale oil and its fraction boiling at 220–340° C. in the production of fuel distillates has been disclosed in RU, A, 2009166, 1994. However, the shale oil or its fraction boiling at 220–340° C. is commercially produced by gasification of shale. This procedure is imperfect in the technical sense, cumbersome and hazardous for the environment as it is accompanied with the production of a large quantity of unusable semicoke containing toxic components, and blends of liquid, mainly high-boiling products of shale gasification, containing toxic phenols. In particular, the most pertinent prior art methods disclosed in RU, A, 2076891, 1997 and RU, A, 2057786, 1996, are dedicated to elimination of shale oil or its fraction boiling at 220–340° C. from the technological process of producing fuel distillates by replacement thereof with tetralin and alkyl derivatives thereof.

The desired fuel distillates produced at separation of the thermal or hydrogen cracking process products in accordance with the invention, are conventional wide fuel fractions: gasoline fraction boiling off at a temperature between 45 and 180° C., diesel fraction boiling off at a temperature between 180 and 360° C., gas oil fraction boiling off at a temperature between 360 and 520° C., whose properties and methods of employment are generally known to persons skilled in the art. The produced fuel distillates can be converted to commercial fuel components and to commercial fuels using conventional oil refinement procedures that are adopted in industry. For instance, gasoline fraction may be subjected to hydrofining to produce a gasoline component with the octane number of 82–93 by a test method. Diesel fraction after being subjected to hydrofining may be employed as a commercial diesel fuel with the cetane number of 48.

Similar fuel fractions are the basic products obtained at implementing the process in accordance with the invention. They may be readily refined to commercial fuels, i.e. the invention ensures the attainment of the result which is not readily apparent from the prior art.

EXAMPLES OF IMPLEMENTING THE INVENTION

The following examples illustrate the advantages of the present invention. In the examples, for the oil residual stock the use was made of:

- a tar from a mixture of the West-Siberian oils, having the following properties: density 948 kg/cu m; element composition, in percentage by mass: C 85.6; H 10.72; S 2.06; N 0.3 (the balance being oxygen and additives); viscosity 17.0 cst; coking ability 11.0 percent by mass; 13.6 percent asphaltenes by mass; 18.4 percent by mass boiling off at a temperature under 520° C.; vanadium and nickel in the amount of 180 g and 90 g per ton, respectively.

Used as sapropelites were:

- a typical Baltic shale having the following properties, in percentage by mass: $A^d$ 47.83; $Co_2{}^d$ min 8.32; $C^{daf}$ 80.40; $H^{daf}$ 9.43; $N^{daf}$ 0.25; $S^d_t$ 0.91; $W^d$ 0.3;
- a typical sulfurous shale having the following properties, in percentage by mass: $A^d$ 44.25; $Co_2{}^d$ min 8.32; $C^{daf}$ 73.54; $H^{daf}$ 9.43; $N^{daf}$ 1.41; $S^d_t$ 5.10; $W^d$ 4.0;
- a Kuzbass sapromixite having the following properties, in percentage by mass: $A^d$ 29.44; $C^{daf}$ 77.06; $H^{daf}$ 8.19; $N^{daf}$ 0.85; $S^d_t$ 0.56; $W^d$ 2.99.

Used as a liquid aromatic additive was a fraction boiling at 300–400° C., having the following properties: refractive index 1.5003; density 8900 kg/cu m; element content, in percentage by mass: C 86.70, H 12.80, S 0.04, N 0.02; 35.6 percent aromatic hydrocarbons by mass. The fraction was obtained by hydrogenating the diesel fraction of thermal and hydrogen cracking products.

To support the attainment of the technical result, the examples also show the use of the following aromatic additives:

- a shale oil produced by gasification of sulfurous shale, having the following properties: density 1033 kg/cu m; refractive index 1.5720; molecular mass 299; 5.0 percent asphaltenes by mass; element content, in percentage by mass: C 79.44; H 9.20; S 5.44; N 1.46 (the balance being oxygen and additives); 71.0 percent by mass boiling off at a temperature between 200 and 340° C.;
- a shale oil fraction produced by gasification of Baltic shale, boiling at 220–340° C. and having the following properties: element content, in percentage by mass: C 82.80, H 9.40, N 0.64, S 0.5 (the balance being oxygen); density 992 kg/cu m; 31 percent phenols by volume;
- tetralin having the following properties: density 9706 kg/cu m; refractive index 1.5412; composition, in percentage by mass: cis- and transdecalins 4.7, tetralin 92.1, naphthalene 3.2;
- a tetralin/methyl tetralin fraction having the following properties: refractive index 1.5407; composition, in percentage by mass: decalin and methyl decalins 1.0, tetralin 79.0, methyl tetralins 1.2;
- a recycle stock boiling above 520° C., having the following properties: density 1000 kg/cu m; coking ability 8.4 percent by mass; 6.3 percent asphaltenes by mass; element content, in percentage by mass: C 88.08, H 9.50, S 1.80, N 0.62; 300 g vanadium and 137 g nickel per ton.

The procedure of thermal or hydrogen cracking of the oil residual stock was carried out either in a rotating autoclave with a volume of 0.5–2 liters or in a flow-through installation with a reactor volume of 6 liters. The thermal cracking procedure was carried out under the following conditions: temperature 425–430° C.; pressure (of nitrogen, own hydrocarbon gases, hydrogen-containing gas) 3 to 4 MPa; space velocity 1.0 to 2.0 $h^{-1}$; gas circulation 600 to 800 liters per liter of the feed stock). The hydrogen cracking conditions were: temperature 425–430° C., hydrogen or hydrogen-containing gas pressure 6.0 to 10 MPa, space velocity 1.0 to 2.0 $h^{-1}$, hydrogen-containing gas circulation 1000–1500 liters per liter of the feed stock.

The process was conducted for 20 to 90 min. It took 40 min for the autoclave to reach its operating temperature.

The liquid aromatic additive and sapropelite comprised 1–5 and 1–10 percent by mass with respect to the oil residual stock, respectively.

The completion of the process was followed by cooling the autoclave, relieving the pressure, releasing gas, discharging liquid products and extracting solids. The liquid products were distilled into fractions boiling under 180° C., at 180° C. to 360° C., 360° C. to 520° C. and a residue boiling above 520° C. In the flow-through installation with a reactor volume of 6 liters, the process was carried out at a temperature between 390 and 440° C., a pressure of 4 MPa at thermal cracking and 10 MPa at hydrogen cracking and a space velocity of 1.0 to 3.0 $h^{-1}$.

The shale/oil mixture for the thermal or hydrogen cracking processes was prepared by sequentially mixing an oil residual stock, in particular tar, a fraction of hydrogenated thermal cracking products boiling at 300–400° C. and a typical Baltic shale. The components were mixed together in a heated agitator at a temperature of 75° C. for an hour.

The resulting mixture was subjected to a double- or three-stage homogenization, the temperature in an activator being 85–95° C. at a first stage, 95–105° C. at a second stage and 105–135° C. at a third stage.

The resulting mixture did not segregate for a long time.

EXAMPLE 1

The starting mixture was prepared by mixing 300 g of tar with 6 g of a typical Baltic shale and 9 g of a fraction of hydrogenated thermal cracking products boiling at 300–400° C. The components were mixed together in a heated agitator at a temperature of 75° C. for an hour. The mixture was then subjected, without homogenization, to thermal cracking.

The thermal cracking procedure was conducted under the pressure of 4 MPa at a temperature between 425 and 430° C. for 30 min. The resulting liquid products were filtered to extract solids. The liquid products were distilled into fractions boiling under 180° C. (gasoline), at 180–360° C. (diesel), 360–520° C. (gas oil) and a residue boiling above 520° C. The process characteristics are set out in Table 1 below.

EXAMPLE 2

The feed stock and process properties were similar to those in Example 1, except for the fact that the feed stock was subjected to a single-stage homogenization at a temperature between 85–95° C. The process characteristics are set out in Table 1 below.

EXAMPLE 3

The feed stock and process properties were similar to those in Example 1, except for the fact that the feed stock was subjected to a double-stage homogenization: at a temperature of 85–95° C. at the first stage and 95–105° C. at the second stage. The process characteristics are set out in Table 1 below.

EXAMPLE 4

The feed stock and process properties were as in Example 1, except for the fact that the feed stock was subjected to a three-stage homogenization: at a temperature of 85–95° C. at the first stage, 95–105° C. at the second stage and 105–135° C. at the third stage. The process characteristic are set out in Table 1 below.

EXAMPLE 5

The feed stock and process properties were as in Example 4, except for the fact that the feed stock was subjected to the additional homogenization at a temperature between 105 and 135° C. at the forth stage.

EXAMPLE 6

The starting feed stock was prepared by mixing 300 g of tar with 6 g of typical Baltic shale and 9 g of shale oil. The components were mixed together in a heated agitator at a temperature of 75° C. for an hour. The mixture was then subjected to a three-stage homogenization in an activator at a temperature of 85–95° C. at the first stage, 95–105° C. at the second stage and 105–135° C. at the third stage.

The thermal cracking procedure was carried out at a pressure of 4 MPa and a temperature between 425 and 430° C. for 30 min. The resulting liquid products were filtered to extract solids. The liquid products were distilled into fractions boiling under 180° C. (gasoline), at 180–360° C. (diesel), 360–520° C. (gas oil) and a residue boiling at a temperature above 520° C. The process characteristics are set out in Table 2 below.

The resulting products had the following properties:

gasoline fraction boiling under 180° C.: refractive index 1.4309; element content, in percentage by mass: C 84.53, H 13.75, S 0.66, N 0.66;

diesel fraction boiling at 180–360° C.: refractive index 1.4813; element content, in percentage by mass: C 85.89, H 12.26, S 1.29, N 0.06;

gas oil fraction boiling at 360–520° C.: refractive index 1.5211, element content, in percentage by mass: C 86.60, H 11.24, S 1.95, N 0.21;

residue boiling above 520° C.: density 1011 kg/cu m; element content, in percentage by mass: C 88.18, H 9.48, S 1.70, N 0.64.

EXAMPLE 7

The feed stock and process properties were similar to those in Example 6, except for the employment of tetralin. The process characteristics are set out in Table 2 below.

EXAMPLE 8

The feed stock and process properties were similar to those in Example 6, except for the employment of shale oil fraction boiling at 220–340° C. The process characteristics are set out in Table 2.

EXAMPLE 9

The feed stock and process properties were similar to those in Example 6, except for the employment of a tetralin/methyl tetralin fraction. The process characteristics are set out in Table 2 below.

EXAMPLE 10

The feed stock and process properties were similar to those in Example 6, except for the employment of a fraction of hydrogenated thermal cracking products boiling at 300–400° C. The fraction comprised 3.0 percent by mass of the starting mixture. The process characteristics are set out in Table 2 below.

EXAMPLE 11

The feed stock and process properties were similar to those in Example 10, except that the fraction comprised 1.0 percent by mass of the starting mixture.

EXAMPLE 12

The feed stock and process properties were similar to those in Example 10, except that the fraction comprised 5.0 percent by mass of the starting mixture. The process characteristics are set out in Table 2 below.

EXAMPLE 13

The mixture was prepared in accordance with the most pertinent prior art method disclosed in RU patent 2076891, 1997, by mixing 300 g of tar with 6.0 g of Baltic shale, 9.0 g of tetralin. The thermal cracking procedure was conducted at a temperature of 425° C., a pressure of 6.0 MPa for an hour. The yield, in percentage by mass with respect to tar, was: gas 3.7; water 0.1; fraction boiling under 200° C. 6.8; fraction boiling at 200–370° C. 52.3; residue boiling above 370° C. 39.4; "coke" on sapropelite mineral portion 0.1. The total yield of products (two fractions) was 59.1 percent with respect to tar mass. The residue was a component of power fuel or bitumen for road construction. The process characteristics are set out in Table 2 below.

EXAMPLE 14

The starting feed stock was prepared by mixing 100 g of tar with 40 g of recycle stock boiling at temperature above 520° C., 2.8 g of typical Baltic shale, and 4.2 g of shale oil, at a temperature between 80 and 100° C. The components were mixed together in a heated agitator at a temperature of 75° C. for an hour. The mixture was then subjected to a three-stage homogenization in an activator at a temperature of 85–95° C. at the first stage, 95–105° C. at the second stage and 105–135° C. at the third stage.

Hydrogen cracking of tar mixed with shale and shale oil was carried out at a temperature of 425° C. for an hour at the hydrogen pressure of 10 MPa and the hydrogen-tar ratio of 800–1000 l/l. The resulting liquid products were filtered to extract solids. The liquid products were subjected to distillation into fractions boiling under 180° C. (gasoline), at 180–360° C. (diesel), 360–520° C. (gas oil) and a residue boiling off above 520° C. The residue boiling above 520° C. was returned to the hydrogen cracking procedure, mixed with the starting tar.

The resulting products had the following properties:

fraction boiling under 180° C.: refractive index 1.4300, element content, in percentage by mass: C 85.20; H 13.90; S 0.70; N 0.07;

fraction boiling at 180–360° C.: refractive index 1.4713, element content, in percentage by mass: C 86.00; H 12.35; S 1.25; N 0.07;

fraction boiling at 360–520° C.: refractive index 1.5305, element content, in percentage by mass: C 85.95; H 11.13; S 1.86; N 0.31;

residue boiling above 520° C.: density 1000 kg/cu m, coking ability 8.4 percent; 6.3 percent asphaltenes, 300 g of vanadium and 137 g of nickel per ton; element content, in percentage by mass: C 88.08; H 9.50; S 1.80; N 0.62.

EXAMPLE 15

The feed stock and process conditions were similar to those in Example 14, except for the employment of tetralin. The process characteristics are set out in Table 3 below.

EXAMPLE 16

The feed stock and process conditions were similar to those in Example 14, except for the employment of shale oil fraction boiling at 220–340° C. The process characteristics are set out in Table 3 below.

EXAMPLE 17

The feed stock and process conditions were similar to those in Example 14, except for the employment of a tetralin/methyl tetralin fraction. The process characteristics are set out in Table 3 below.

EXAMPLE 18

The feed stock and process condition were similar to those in Example 14, except for the employment of a fraction of hydrogenated hydrogen cracking products boiling at 300–400° C. The fraction comprised 3.0 percent of the starting mixture mass. The process characteristics are set out in Table 3 below.

EXAMPLE 19

The feed stock and process conditions were similar to those in Example 18, except that the fraction comprised 1.0 percent of the starting mixture mass. The process characteristics are set out in Table 3 below.

EXAMPLE 20

The feed stock and process conditions were similar to those in Example 18, except that the fraction comprised 5.0 percent of the starting mixture mass. The process characteristics are set out in Table 3 below.

EXAMPLE 21

The feed stock and process conditions were similar to those in Example 18, except for the fact that the starting mixture was subjected to a double-stage homogenization in an activator at a temperature of 85–95° C. at the first stage and 95–105° C. at the second stage. The process characteristics are set out in Table 3 below.

EXAMPLE 22

The mixture was prepared in accordance with the most pertinent prior art method disclosed in RU patent 2057786, 1996, by mixing, in percentage by mass, tar 100, Baltic shale 2.0 including 1.2 percent mineral portion, tetralin 2.0 g, at hydrogen consumption of 1.9. The hydrogen cracking procedure was conducted at a temperature of 425° C., a pressure of 10.0 MPa for an hour. The yield of products, in percentage by mass with respect to tar, was gas 7.3, water 0.5, fraction boiling under 200° C. 14.3, fraction boiling at 200–370° C. 74.8, residue boiling above 370° C. 0.3; "coke" on sapropelite mineral portion 6.8,. The total yield of products in the form of fraction boiling under 200° C., fraction boiling at 200–370° C. and residue boiling above 370° C. was 89.1 percent by mass.

TABLE 1

Examples of thermal cracking process as a function of a number of mixture homogenization stages

| Content in the starting feed stock, percent by mass | Examples 1 | 2 | 3 | 4 | 5 |
|---|---|---|---|---|---|
| Tar | 100.0 | 100.0 | 100.0 | 100.0 | 100.0 |
| Baltic shale, incl. mineral portion | 2.0 | 2.0 | 2.0 | 2.0 | 2.0 |
| Fraction of hydrogenated thermal cracking products boiling at 300–400° C. | 1.3 | 1.3 | 1.3 | 1.3 | 1.3 |
| Conditions of mixture preparation: | 3.0 | 3.0 | 3.0 | 3.0 | 3.0 |
| temperature, ° C. | 75 | 85–95 | 85–105 | 85–135 | 105–135 |
| pressure, Mpa | atm. | atm. | atm. | atm. | atm. |
| duration, min | 60 | 60 | 60 | 60 | 60 |
| Conditions of thermal cracking process: | | | | | |
| temperature, ° C. | 425 | 425 | 425 | 425 | 425 |
| pressure, Mpa | 4.0 | 4.0 | 4.0 | 4.0 | 4.0 |
| duration, min | 60 | 60 | 60 | 60 | 60 |
| Yield of products with respect to tar, percent by mass: | | | | | |
| gas | 3.0 | 4.8 | 5.1 | 7.1 | 7.4 |
| water | 0.1 | 0.5 | 1.0 | 1.0 | 1.0 |
| fraction boiling under 180° C. | 5.7 | 6.3 | 5.6 | 13.3 | 12.8 |
| fraction boiling at 180–360° C. | 30.3 | 35.8 | 48.4 | 50.7 | 50.1 |
| fraction boiling at 360–520° C. | 5.6 | 5.0 | 5.1 | 6.0 | 7.0 |
| residue boiling above 520° C. | 57.0 | 49.5 | 37.9 | 23.0 | 23.3 |
| Coke on sapropelite mineral portion | 3.3 | 3.1 | 1.9 | 3.9 | 3.4 |

TABLE 2

Examples of Thermal Cracking Process

| Content in the starting feed stock, percent by mass | Examples 6 | 7 | 8 | 9 | 10 | 11 | 12 | 13* |
|---|---|---|---|---|---|---|---|---|
| Tar | 100.0 | 100.0 | 100.0 | 100.0 | 100.0 | 100.0 | 100.0 | 100.0 |
| Baltic shale, incl. mineral portion | 2.0 | 2.0 | 2.0 | 2.0 | 2.0 | 2.0 | 2.0 | 2.0 |
| | 1.3 | 1.3 | 1.3 | 1.3 | 1.3 | 1.3 | 1.3 | 1.2 |
| Tetralin | — | 3.0 | — | — | — | — | — | 3.0 |
| Shale oil | 3.0 | — | — | — | — | — | — | — |
| Shale oil fraction boiling at 220–340° C. | — | — | 3.0 | — | — | — | — | — |
| Tetralin-methyl tetralin fraction | — | — | — | 3.0 | | — | — | — |
| Fraction of hydrogenated thermal cracking products boiling at 300–400° C. | — | — | — | | 3.0 | 1.0 | 5.0 | — |
| Process conditions: | | | | | | | | |
| temperature, ° C. | 425 | 425 | 425 | 425 | 425 | 425 | 425 | 425 |
| pressure, Mpa | 4.0 | 4.0 | 4.0 | 4.0 | 4.0 | 4.0 | 4.0 | 6.0 |
| duration, min | 60 | 60 | 60 | 60 | 60 | 60 | 60 | 60 |
| Yield of products with respect to tar, percent by mass: | | | | | | | | |
| gas | 7.8 | 7.5 | 7.5 | 5.7 | 4.8 | 4.9 | 7.3 | 3.7 |
| water | 1.0 | 1.0 | 1.0 | 1.0 | 1.0 | 1.0 | 1.0 | 0.1 |
| fraction boiling under 180° C. | 12.0 | 10.0 | 12.1 | 6.9 | 6.0 | 5.5 | 5.5 | 6.8 |
| fraction boiling at 180–360° C. | 42.9 | 46.0 | 41.9 | 46.8 | 49.2 | 46.7 | 48.7 | 52.3 |
| fraction boiling at 360–520° C. | 15.1 | 16.5 | 10.5 | 6.3 | 11.8 | 11.0 | 11.5 | }39.4 |
| residue boiling above 520° C. | 22.5 | 21.1 | 29.5 | 33.0 | 30.1 | 31.9 | 31.1 | 0.1 |
| Coke on sapropelite mineral portion | 3.7 | 2.5 | 2.5 | 2.3 | 2.1 | 2.0 | 1.9 | |

*In Example 13 the yield by fractions is given for boiling temperatures under 200° C., from 200 to 370° C. and for residue boiling above 370° C.

TABLE 3

Examples of Hydrogen Cracking Process

| Content in the starting feed stock, percent by mass | Examples 14 | 15 | 16 | 17 | 18 | 19 | 20 | 21 | 22* |
|---|---|---|---|---|---|---|---|---|---|
| Tar | 100.0 | 100.0 | 100.0 | 100.0 | 100.0 | 100.0 | 100.0 | 100.0 | 100.0 |
| Baltic shale, incl. mineral portion | 2.0 | 2.0 | 2.0 | 2.0 | 2.0 | 2.0 | 2.0 | 2.0 | 2.0 |
| | 1.3 | 1.3 | 1.3 | 1.3 | 1.3 | 1.3 | 1.3 | 1.2 | 1.2 |
| Tetralin | — | 3.0 | — | — | — | — | — | — | 2.0 |
| Shale oil | 3.0 | — | — | — | — | — | — | | |
| Shale oil fraction boiling at 220–340° C. | — | — | 3.0 | — | — | — | — | | |
| Tetralin-methyl tetralin fraction | — | — | — | 3.0 | — | — | — | — | |
| Fraction of hydrogenated thermal cracking products boiling at 300–400° C. | — | — | — | — | 3.0 | 1.0 | 5.0 | 3.0 | |
| Recycle stock boiling above 520° C. | 40.0 | 40.0 | 40.0 | 40.0 | 40.0 | 40.0 | 40.0 | 40.0 | 40.0 |
| Hydrogen consumption, percent | 2.5 | 2.8 | 2.0 | 2.2 | 1.8 | 1.7 | 1.9 | 1.7 | 1.9 |
| Process conditions: | | | | | | | | | |
| temperature, ° C. | 425 | 425 | 425 | 425 | 425 | 425 | 425 | 425 | 425 |
| pressure, Mpa | 10.0 | 10.0 | 10.0 | 10.0 | 10.0 | 10.0 | 10.0 | 10.0 | 10.0 |
| space velocity, $hour^{-1}$ | 1.0 | 1.0 | 1.0 | 1.0 | 1.0 | 1.0 | 1.0 | 1.0 | 1.0 |
| hydrogen/stock ratio, l/l | 800 | 800 | 800 | 800 | 800 | 800 | 800 | 800 | 800 |
| Yield of products with respect to tar, percent by mass: | | | | | | | | | |
| gas | 6.0 | 7.1 | 7.0 | 7.5 | 6.4 | 6.1 | 6.7 | 6.4 | 7.3 |
| water | 0.5 | 0.5 | 0.5 | 0.5 | 0.5 | 8 | 0.5 | 0.5 | 0.5 |
| fraction boiling under 180° C. | 19.0 | 24.0 | 21.2 | 21.2 | 16.7 | 14.1 | 15.3 | 14.0 | 14.3 |
| fraction boiling at 180–360° C. | 63.0 | 62.0 | 61.8 | 61.8 | 61.8 | 62.2 | 64.3 | 60.0 | }74.8 |
| fraction boiling at 360–520° C. | 11.0 | 9.0 | 10.8 | 10.8 | 11.1 | 11.1 | 11.2 | 14.5 | 0.3 |
| residue boiling above 520° C. | 1.5 | 1.3 | 1.7 | 1.7 | 6.4 | 6.0 | 6.0 | 7.5 | 6.8 |
| Coke on sapropelite mineral portion | 6.5 | 3.9 | 4.0 | 4.0 | 3.9 | 4.7 | 4.9 | 3.8 | |

*In Example 22 the yield by fractions is given for boiling temperatures under 200° C., 200–370° C., and for residue boiling above 370° C.

Analysis of data listed in Table 1 shows as follows. A single-stage homogenization of the starting mixture, carried out before thermal or hydrogen cracking raised the yield of products from 41.6 (under the conditions of Example 1) to 47.1 percent by mass with respect to tar (under the conditions of Example 2), while at a double-stage treatment at a temperature of 85–95° C. at the first stage and 95–105° C. at the second stage the yield was raised up to 59.1 (under the conditions of Example 3). The three-stage treatment including the two aforementioned stages and the third stage at a temperature between 105 and 135° C. provided the total yield of gasoline fraction boiling under 180° C., diesel fraction boiling at 180–360° C. and gas oil fraction boiling at 360–520° C. as high as 70.0 percent by mass with respect to tar. As compared to the most pertinent prior art using tetralin in the amount of 3 percent by mass with respect to tar and similar process conditions (Example 13), the yield of products was increased by 10.9 percent by mass with respect to tar (the yield in Example 13 was 59.1 percent by mass).

Therefore, the comparison of the thermal cracking data in Examples 3, 4 and 13 is the supporting evidence for the attainment of the technical result of the present invention owing to the employment of a double- and three-stage homogenization of the starting shale/oil mixture and the use, as a liquid aromatic additive, of a fraction of hydrogenated thermal cracking products boiling at 300–400° C. in the amount of 3 percent by mass. The above technical result cannot be attained using a single-stage homogenization at a temperature of 85–95° C.

The addition of the forth stage of oil/shale mixture homogenization carried out at a temperature of 105–135° C. (Example 5) did not contribute to the total yield of products. Under the conditions of Example 5 the yield was 69.9 percent by mass in reference to tar, i.e. substantially equal to the yield under the conditions of Example 4. Thus, there is no point in increasing the number of stages in excess of three, as it does not provide the noticeable increase in the yield of products, and yet it can raise power consumption and, consequently, the final product cost.

Example 6 illustrates the employment of shale oil as a liquid aromatic additive in the thermal cracking process. The starting mixture was subjected to a three-stage homogenization. The total yield of three fractions was 70 percent by mass with respect to tar.

In Example 7 tetralin was used as a liquid additive. The starting mixture was subjected to a three-stage homogenization. The total yield was 72.5 percent by mass with respect to tar. In Example 13 under similar conditions, except for the homogenization step, the yield was 59.1 percent by mass with respect to tar. The Example illustrates high efficiency of the three-stage homogenization in raising the total yield.

Example 8 demonstrates the method efficiency when a shale oil fraction boiling at 220–340° C. was used as a liquid aromatic additive. The total yield of products was 64.5 percent by mass with respect to tar.

Example 9 illustrates the employment of tetralin-methyl tetralin fraction as a liquid aromatic additive. The total yield of products was 60.0 percent by mass with respect to tar. The above examples in which the shale/oil mixture was subjected to the three-stage homogenization demonstrate that the total yield of products exceeded that of the prior art method using tetralin, which does not involve homogenization of the starting shale mixture in an activator.

Examples 10, 11 and 12 illustrate the embodiment of the present invention using a fraction of hydrogenated thermal cracking products boiling at 300–400° C. as a liquid aromatic fraction. The additive concentration in the examples was 3.0, 1.0 and 5.0 percent by mass with respect to tar, respectively. Example 10 demonstrated the highest total yield of fractions boiling under 180° C., at 180–360° C. and 360–520° C. in the amount of 67 percent by mass with respect to tar. When the additive content was 5.0 percent by mass, the process yielded 65.7 percent products by mass with respect to tar, i.e. less than in the case of 3.0 percent. The reduction in the content of the fraction of hydrogenated thermal cracking products boiling at temperature 300–400° C. to less than 1.0 percent by mass failed to provide the attainment of the technical result of the present invention as the yield of products was reduced. The increase of the content of the fraction boiling at 300–400° C. over the upper limit of 5 percent failed to provide the increase in the yield of products, contributing only to the final product cost due to unproductive consumption of the diesel fraction.

Therefore, the fraction of hydrogenated thermal cracking products boiling at temperature 300–400° C. should be introduced into the oil residual stock in the amount of 1.0–5.0 percent by mass with respect to the stock.

Example 14 illustrates the utilization of shale oil in the present invention as a liquid aromatic additive in the hydrogen cracking process. The shale/oil mixture was subjected to a three-stage homogenization in an activator. Under the conditions of Example 14, the yield of three fractions was 93.0 percent by mass with respect to tar.

Example 15 demonstrates the process characteristics when tetralin was used as a liquid aromatic additive. Under the conditions of Example 15 the yield was 95.0 percent by mass with respect to tar, hydrogen consumption being 2.5 percent by mass.

Example 16 illustrates the use of a shale oil fraction boiling at 220–340° C. as a liquid additive. Under the conditions of Example 16 the yield was 93.8 percent by mass with respect to tar.

Example 17 illustrates the use of a tetralin-methyl tetralin fraction as a liquid aromatic additive. Under the conditions of Example 17 the yield was 93.1 percent by mass at the hydrogen consumption of 2.2 percent by mass with respect to tar.

Examples 18, 19 and 20 demonstrate the efficiency of the present invention wherein a fraction of hydrogenated hydrogen cracking products boiling at 300–400° C. was used as a liquid aromatic additive. The fraction concentration, in percentage by mass with respect to tar, was 3.0 in Example 18; 1.0 in Example 19 and 5.0 in Example 20. In Example 18 the yield of three fractions, in percentage by mass with respect to tar, was 89.6 at the hydrogen consumption of 1.8 percent.

Reducing the fraction concentration to 1.0 percent by mass under the conditions of Example 19 resulted in the reduced yield of 87.4 percent by mass with respect to tar.

Increasing the fraction concentration up to 5.0 percent by mass under the conditions of Example 20 failed to significantly contribute to the yield (the yield under the conditions of Example 20 was 90.8 percent by mass with respect to tar) and only raised the cost of the final product due to unproductive consumption of diesel fraction. Therefore, the quantity of the added fraction of hydrogenated hydrogen cracking products boiling at 300–400° C. should be from 1.0 to 5.0 percent by mass. The yield of three fractions under the conditions of Example 21 at the double-stage homogenization was 88.5 percent by mass with respect to tar. The total yield from the process, including the residue boiling above 520° C., was 96.0 percent by mass with respect to tar. Under the conditions of Example 22 the combined yield of products, including gasoline fraction boiling under 200° C., fraction boiling from 200 to 370° C. and residue boiling above 200° C., was 89.1 percent by mass with respect to tar.

From the comparison of the results of implementing the method in accordance with the invention in Examples 18, 19, 20, 21 and Example 22 representing the prior art method using tetralin, it follows that owing to the homogenization carried out in an activator and the employment of a fraction of hydrogenated hydrogen cracking products as a liquid aromatic additive, expensive tetralin can be replaced in the process of fuel distillates production, while the yield stays substantially at the level of 90.0 percent by mass in reference to tar. The three-stage homogenization provides a noticeable increase in the total yield of products as compared to the prior art. Consequently, the present invention ensures the attainment of the technical result which is not readily apparent from the prior art.

Industrial Applicability

The present invention is applicable in oil refinement for producing fuel distillates which are used as the feed stock to produce motor and jet engine fuels.

What is claimed is:

1. A method for producing fuel distillates from oil residual stock, including mixing the oil residual stock with sapropelite and a liquid aromatic additive, subjecting the resulting mixture to hydrogen or thermal cracking, and extracting desired products, characterized by subjecting the mixture, prior to said hydrogen or thermal cracking, to at least a double-stage homogenization in an activator at a temperature of 85–105° C., said liquid aromatic additive being a fraction of hydrogenated thermal or hydrogen cracking products boiling at 300–400° C. in the amount of 1 to 5 percent by mass with respect to the oil residual stock.

2. A method according to claim 1, wherein at said step of double-stage homogenization the mixture is maintained in the activator at a temperature of 85–95° C. at a first stage and 95–105° C. at a second stage.

3. A method according to claim 1, wherein said mixture is subjected to a three-stage homogenization in the activator, the mixture being maintained at a temperature of 85–95° C. at a first stage, 95–105° C. at a second stage and 105–135° C. at a third stage.

* * * * *